US008474469B2

(12) United States Patent
Nakayama et al.

(10) Patent No.: US 8,474,469 B2
(45) Date of Patent: Jul. 2, 2013

(54) CLEANING DEVICE OF HAIR REMOVING APPARATUS

(75) Inventors: Satoshi Nakayama, Hikone (JP); Kensaku Kanada, Hikone (JP)

(73) Assignee: Panasonic Corporation (JP)

( * ) Notice: Subject to any disclaimer, the term of this patent is extended or adjusted under 35 U.S.C. 154(b) by 1532 days.

(21) Appl. No.: 11/826,238

(22) Filed: Jul. 13, 2007

(65) Prior Publication Data

US 2008/0016693 A1 Jan. 24, 2008

(30) Foreign Application Priority Data

Jul. 21, 2006 (JP) ..... 2006-199949

(51) Int. Cl.
*B08B 3/00* (2006.01)
*B08B 3/12* (2006.01)
*B08B 6/00* (2006.01)

(52) U.S. Cl.
USPC ..... 134/184

(58) Field of Classification Search
USPC ..... 134/184
See application file for complete search history.

(56) References Cited

U.S. PATENT DOCUMENTS 4,347,671 A * 9/1982 Dias et al. ..... 34/402
5,614,030 A * 3/1997 Braun ..... 134/22.1
6,263,890 B1 * 7/2001 Hoser ..... 134/111
6,384,384 B1 * 5/2002 Connolly et al. ..... 219/481
2006/0011225 A1 * 1/2006 Saito et al. ..... 134/201
2006/0021638 A1 * 2/2006 Eichhorn et al. ..... 134/56 R
2006/0107971 A1 * 5/2006 Chasen et al. ..... 134/10
2006/0162749 A1 7/2006 Saito et al.

FOREIGN PATENT DOCUMENTS

GB 2083745 A * 3/1982
JP 59105500 A * 6/1984
JP 61-234888 10/1986
JP 2006-516004 6/2006
SU 896353 1/1982
WO 2004/066780 8/2004
WO WO 2004066780 A1 * 8/2004

OTHER PUBLICATIONS

JP-59105500 English Translation.*
JP 59-105500 English Translation Yoshida et al. Jun. 1984.*

* cited by examiner

*Primary Examiner* — Michael Barr
*Assistant Examiner* — Charles W Kling
(74) *Attorney, Agent, or Firm* — Bacon & Thomas, PLLC

(57) ABSTRACT

A cleaning device of a hair removing apparatus having a hair clipping unit for removing hair includes a cleaning basin for accommodating the hair clipping unit therein; a fluid circulating mechanism for supplying or recovering cleaning fluid into or from the cleaning basin; a drying mechanism for drying the hair clipping unit in the cleaning basin after the hair clipping unit is cleaned; and a controller for controlling the fluid circulating mechanism and the drying mechanism. The controller transmits a control signal to the hair removing apparatus to drive the hair clipping unit while the drying mechanism is being operated.

8 Claims, 7 Drawing Sheets

CLEANING DEVICE OF HAIR REMOVING APPARATUS

FIELD OF THE INVENTION

The present invention relates to a cleaning device for cleaning a hair removing apparatus such as an electric shaver, an epilator, and the like.

BACKGROUND OF THE INVENTION

Conventionally, as a cleaning device for cleaning a hair clipping unit of a hair removing apparatus (e.g., an electric shaver, an epilator, etc.), there is known a device having a cleaning basin for accommodating the hair clipping unit therein; a cleaning fluid circulating mechanism for supplying or recovering cleaning fluid into or from the cleaning basin; a drying mechanism for drying the hair clipping unit after the hair clipping unit is cleaned; and a control unit for controlling the cleaning fluid circulating mechanism and the drying mechanism (see, e.g., Japanese Patent Laid-open Application No. 2004-261208).

In the above conventional cleaning device, when a hair removing apparatus is placed on the cleaning device, the control unit of the cleaning device is electrically connected to a control circuit inside the hair removing apparatus. While the hair clipping unit of the hair removing apparatus is being cleaned in the cleaning basin, the control unit of the cleaning device transmits a control signal to the control circuit of the hair removing apparatus, and in response to the control signal, the control circuit of the hair removing apparatus drives the hair clipping unit. By driving the hair clipping unit during the cleaning of the hair removing apparatus in the cleaning basin, the hair clipping unit can be cleaned efficiently.

When the cleaning process is finished, the operation of the hair clipping unit is stopped, and the hair clipping unit is dried by the operation of a fan or the like via the drying mechanism. However, this method is ineffective in drying out water drops from remote or hard to reach areas of the hair clipping unit. Such conventional drying mechanisms leave no other choice than to wait for the water drops to dry out naturally or to forcibly blow it out with an additional fan. Accordingly, the current state of the art requires longer time for the hair clipping unit to dry out sufficiently.

Further, since some of the cleaning fluid is stuck to the hair clipping unit after the hair clipping unit is cleaned, sebum or contaminants dissolved in the cleaning fluid would still remain on the surface of the hair clipping unit if the hair clipping unit is dried only by blowing wind thereto. Accordingly, there occurs a problem that contaminants remain stuck to the hair clipping unit even after the hair clipping unit is cleaned.

SUMMARY OF THE INVENTION

It is, therefore, an object of the present invention to provide a cleaning device of a hair removing apparatus, capable of drying a hair clipping unit of the hair removing apparatus sufficiently using only a short amount of time, while preventing sebum or contaminants from remaining on the surface of the hair clipping unit after the hair clipping unit is dried.

In accordance with an aspect of the present invention, there is provided a cleaning device of a hair removing apparatus having a hair clipping unit for removing hair, including:

a cleaning basin for accommodating the hair clipping unit therein;

a fluid circulating mechanism for supplying or recovering cleaning fluid into or from the cleaning basin;

a drying mechanism for drying the hair clipping unit in the cleaning basin after the hair clipping unit is cleaned; and a controller for controlling the fluid circulating mechanism and the drying mechanism, wherein the controller transmits a control signal to the hair removing apparatus to drive the hair clipping unit while the drying mechanism is being operated.

Under the above-described configuration of the cleaning device of the hair removing apparatus, fluid drops of the cleaning fluid that are attached to the hair clipping unit are shaken and fallen off by the operation of the hair clipping unit. Also, by this operation, the surface areas of fluid drops still remaining on the hair clipping unit is enlarged, which facilitates the drying operation. Further, since the cleaning fluid attached to the hair clipping unit are forcibly shaken and fallen, sebum or other contaminants dissolved in the cleaning fluid are prevented from being left on the surface of the hair clipping unit after it is dried.

It is preferable that the controller drives the hair clipping unit intermittently while the drying mechanism is being operated. By driving the hair clipping unit intermittently during the drying operation, the reduction of the lifetime of the hair clipping unit caused by driving it continuously throughout the drying operation and the influence of noise generated when it is driven can be reduced. Particularly, under the configuration in which the hair clipping unit is a cutter block moving slidably, the edges of blades would be abraded when the hair clipping unit is driven for a long period of time. However, the influence upon the lifetime of the edges of the blades can be certainly reduced by driving the hair clipping unit intermittently.

It is preferable that during the intermittent driving of the hair clipping unit, an operating time of the hair clipping unit is set by the controller to be shorter than a pause time thereof. By minimizing the operating time of the hair clipping unit, the reduction of the lifetime of the hair clipping unit caused by driving it during the drying operation and the influence of noise generated when it is driven can be reduced more effectively.

It is preferable that during the intermittent driving of the hair clipping unit, the pause time is set by the controller to increase with a lapse of time after the intermittent driving of the hair clipping unit has begun. Since the amount of the cleaning fluid remaining on the hair clipping unit decreases with the lapse of time after the intermittent driving of the hair clipping unit has begun, the time period before the fluid drops remaining on the hair clipping unit are collected at the lower part of the hair clipping unit becomes longer. Thus, by increasing the interval between an end of a current operating time and a start of a next operating time with the lapse of time, the reduction of the lifetime of the hair clipping unit caused by driving it for a long period of time during the drying operation and the influence of noise generated when it is driven can be reduced more effectively.

It is preferable that the cleaning device further includes a dryness detecting unit for detecting dryness of the hair clipping unit of the hair removing apparatus, wherein the controller stops the operation of the hair clipping unit when it determines that the hair clipping unit is completely dried based on a detection signal provided by the dryness detecting unit. By stopping the operation of the hair clipping unit after it is completely dried, the reduction of the lifetime of the hair clipping unit caused by driving it for a long period of time during the drying operation and the influence of noise generated when it is driven can be reduced more effectively.

It is preferable that the dryness detecting unit be made from a temperature sensor for detecting the temperature of the hair clipping unit. In comparison with the hair clipping unit before it is completely dried, the temperature of the hair clipping unit after it is completely dried is higher due to the absence of evaporation heat of the cleaning fluid. Thus, by using the temperature sensor, it can be certainly determined whether or not the hair clipping unit is completely dried.

Further, the above-described configurations may be appropriately combined without departing from the scope of the present invention In accordance with the embodiments of the present invention, the hair clipping unit can be dried sufficiently for a short period of time, while preventing sebum or contaminants from remaining on the surface of the hair clipping unit after the hair clipping unit is dried.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF EMBODIMENTS

Figure 1:
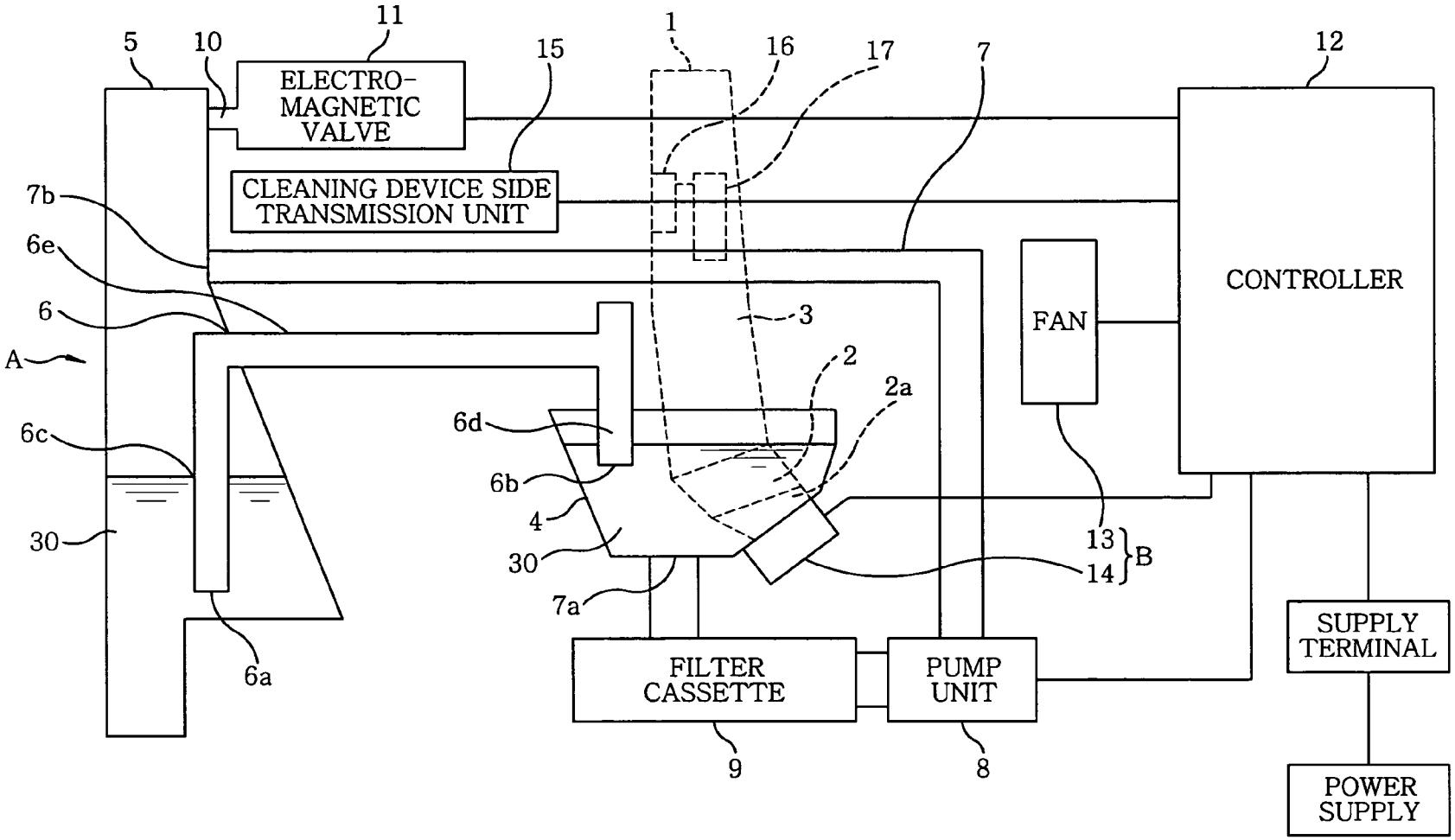
FIG. 1 illustrates a block diagram to show a schematic configuration of a cleaning device of a hair removing apparatus in accordance with a first embodiment of the present invention.

Hereinafter, an embodiment of the present invention will be described with reference to the accompanying drawings. FIG. 1 shows a hair removing apparatus 1 in accordance with a first embodiment of the present invention and a cleaning device for cleaning a hair clipping unit 2 of the hair removing apparatus 1. A basic configuration of the cleaning device of this embodiment is identical with that of the conventional cleaning device described above, so an explanation thereof will be omitted, and only a schematic block diagram thereof is provided in FIG. 1.

The hair removing apparatus 1 illustrated by a dotted line of FIG. 1 is, for example, an electric shaver or an epilator. The hair removing apparatus 1 includes the hair clipping unit 2 for removing hair, which is provided at a leading end side (lower side in FIG. 1) of the hair removing apparatus main body 3 which is designed to be gripped by one hand. The hair clipping unit 2 has a driving body 2*a* at its leading end. By driving the driving body 2*a*, the hair clipping unit 2 performs a hair trimming operation. If the hair removing apparatus 1 is an electric shaver, the driving body 2*a* is, for example, a cutter block for cutting hair, including a stationary blade and a movable blade which slidably moves with respect to the stationary blade. Further, if the hair removing apparatus 1 is an epilator, the driving body 2*a* may be, for example, a series of tweezer type grasping members grasping and pulling out multiple hairs by making rotary and opening/closing motions.

The cleaning device indicated by a solid line of FIG. 1 includes a cleaning basin 4 having a bowl shape with an open top; and a connection stand (not shown) serving as a fixing member. When the hair removing apparatus 1 is fixed by means of the connection stand with the hair clipping unit 2 facing downward, the hair clipping unit 2 is located inside the cleaning basin 4.

A fluid circulating mechanism A for supplying or recovering cleaning fluid 30 into or from the cleaning basin 4 includes a reservoir 5 for storing the cleaning fluid 30 therein; a supply path 6 connecting a suction port 6a opened at a bottom portion of the reservoir 5 with a discharge port 6*b* opened at an upper portion of the inside of the cleaning basin 4; and a return path 7 connecting a drain port 7*a* opened at a bottom portion of the cleaning basin 4 with a return port 7*b* opened at an upper portion of the reservoir 5; a pump unit 8 disposed on the return path 7; a filter cassette 9 disposed upstream of the pump unit 8 on the return path 7; a vent hole 10 opened at an upper portion of the reservoir 5 to be located above the return port 7*b*, the vent hole 10 communicating with the exterior air; and an electromagnetic valve 11 for opening or closing the vent port 10. Further, the supply path 6 has substantially a one side opened rectangular shape when viewed from side, which is fabricated by connecting upper ends of a pair of vertical paths 6*c* and 6*d* vertically connected to the suction port 6*a* and the discharge port 6*b*, respectively, with a horizontal path 6*e*.

The pump unit 8 and the electromagnetic valve 11 of the fluid circulating mechanism A are electrically connected to a controller 12 which is embedded in the cleaning device. The controller 12 performs a driving control of the pump unit 8 and the electromagnetic valve 11 at a proper timing, whereby a supply and a recovery operation of the cleaning fluid 30 is properly carried out between the reservoir 5 and the cleaning basin 4. Explanation of this timing will be provided later.

Further, a drying mechanism B for drying the hair clipping unit 2 placed in the cleaning basin 4 includes a fan 13 installed diagonally above the open top of the cleaning basin 4; and a heater 14 installed at a bottom portion of the cleaning basin 4. The fan 13 and the heater 14 are electrically connected to the controller 12. The controller 12 controls power supplies to the fan 13 and the heater 14, and thus the hair clipping unit 2, particularly its driving body 2*a*, is forcibly dried by heat and air flow thus generated.

Here, a cleaning device side transmission unit 15 made up of a connection terminal is disposed at a proper location of the cleaning device (e.g., at an outer surface of the connection stand), and the cleaning device side transmission unit 15 and the controller 12 embedded in the cleaning device are electrically connected with each other. Further, at an outer surface of the hair removing apparatus main body 3 which locates above the hair clipping unit 2 when the hair removing apparatus 1 is fixed in place, a hair removing apparatus side transmission unit 16 made up of a connection terminal is provided. The hair removing apparatus side transmission unit 16 and a control circuit 17 embedded in the hair removing apparatus main body 3 are electrically connected with each other. The control circuit 17 controls the entire operation of the hair removing apparatus 1, including a driving control of the driving body 2*a* of the hair clipping unit 2.

Now, a control mechanism for cleaning the hair removing apparatus 1 by using the cleaning device having the above-described configuration will be explained. First, a user fills the reservoir 5 of the cleaning device with the cleaning fluid 30 such that a fluid surface is located within a proper spatial range between the suction port 6a and the return port 7*b*. At this initial stage, the cleaning basin 4 is empty.

The user grips the hair removing apparatus 1 in a manner that the hair clipping unit 2 faces downward, and fixes the thus postured hair removing apparatus 1 at a certain position of the cleaning device by using, e.g., the connection stand or the like. At this time, the hair clipping unit 2 is supported and fixed at a position being in contact with the inner bottom surface of the cleaning basin 4. Further, when the hair clipping unit 2 is fixed to the cleaning device, the connection terminal forming the cleaning device side transmission unit 15 and the connection terminal forming the hair removing apparatus side transmission unit 16 are brought into contact with each other, whereby the two transmission units 15 and 16 are then electrically connected with each other.

If a start button (not shown) provided on the cleaning device is turned on after the cleaning fluid 30 is filled and the hair removing apparatus 1 is fixed, the controller 12 closes the electromagnetic valve 11 to seal up the vent port 10 and drives the pump unit 8. The pump unit 8 serves to generate a pressure for pumping the fluid from the cleaning basin 4 to the reservoir 5 through the return path 7. At an initial stage where the cleaning basin 4 is empty without containing therein the cleaning fluid 30, the air is sent into the upper space of the reservoir 5 from the empty cleaning basin 4 via the filter cassette 9 and the pump unit 8 on the return path 7. Since the reservoir 5 is in a hermetical state due to the electromagnetic valve 11 being closed, the internal pressure of the reservoir 5 increases with the inflow of the air, and if the fluid level reaches the inside of the horizontal path 6e of the supply path 6 due to the increase of the internal pressure, the cleaning fluid 30 stored in the reservoir 5 is pressure-ejected into the cleaning basin 4 through the supply path 6. At this time, the controller 12 stops the pump unit 8 to prevent the outflow of the cleaning fluid 30 through the drain port 7a which is open at the bottom portion of the cleaning basin 4. However, the supply of the cleaning fluid 30 into the cleaning basin 4 from the supply path 6 is continued while the internal pressure of the reservoir 5 is maintained high to support the above-described fluid level.

After the lapse of a specific time period after the pump unit 8 is stopped, the controller 12 opens the electromagnetic valve 11 to thereby open the vent port 10 and allows the air inside the reservoir 5 to interact with the exterior air. As a result, the internal pressure of the reservoir 5 decreases down to an atmospheric pressure level, so that the supply of the cleaning fluid 30 from the supply path 6 into the cleaning basin 4 is stopped. The storage amount of the cleaning fluid 30 in the cleaning basin 4 is set to be at a level such that an overflow of the cleaning fluid 30 in the cleaning basin 4 is prevented when the hair clipping unit 2 of the hair removing apparatus 1 is submerged in the cleaning fluid 30 in the cleaning basin 4. Further, though not shown, the cleaning basin 4 may be provided with an overflow port to allow the overflowed cleaning fluid 30 to flow downward into the filter cassette 9 if the fluid surface reaches the overflow port.

The hair clipping unit 2 is maintained submerged in the cleaning fluid 30 within the cleaning basin 4 for a set time period, during which hair residues or sebum stuck to the hair clipping unit 2 are removed by the action of the cleaning fluid 30. Further, at this time, a control signal can be transmitted from the controller 12 to the control circuit 17 inside the hair removing apparatus main body 3 via the cleaning device side transmission unit 15 and the hair removing apparatus side transmission unit 16 that are in contact with each other, to drive the driving body 2*a* of the hair clipping unit 2 submerged in the cleaning fluid 30. By this control, the cleaning effect of the hair clipping unit 2 can be further improved.

After the cleaning operation is completed, the controller 12 drives the pump unit 8 while keeping the electromagnetic valve 11 open, to thereby direct the soiled cleaning fluid 30 in the cleaning basin 4 back into the reservoir 5 through the return port 7*b* of the return path 7 via the drain port 7a, the filter cassette 9 and the pump unit 8. At this time, since the electromagnetic valve 11 is open and, thus, the vent port 10 is opened to the exterior air, the internal pressure of the reservoir 5 does not increase, therefore an ejection of the cleaning fluid 30 from the reservoir 5 into the cleaning basin 4 through the supply path 6 is avoided. The soiled cleaning fluid 30 is filtered while it passes through the filter cassette 9 and is returned into the reservoir 5 after the hair residues or sebum are removed therefrom. Thus, purified cleaning fluid 30 is stored back into the reservoir 5 to be used again later.

After the recovery of the cleaning fluid 30 is completed, the controller 12 starts the fan 13 and the heater 14, to thereby blow air to the hair clipping unit 2 disposed in the cleaning basin 4 from diagonally above and to supply heat from beneath. As a result, the cleaning fluid 30 stuck to the hair clipping unit 2 is dried.

Figure 2:
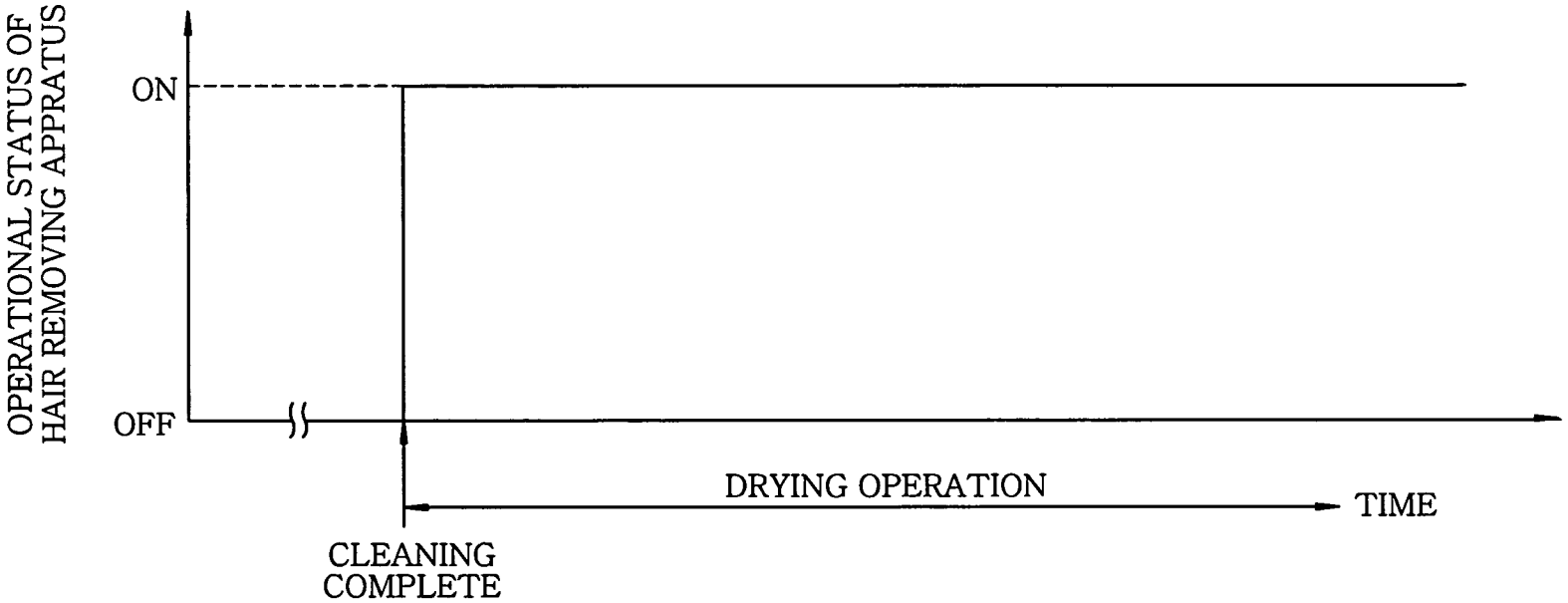
FIG. 2 illustrates a timing chart to schematically describe a first example of an operational status of the hair removing apparatus during a drying operation of the cleaning device of FIG. 1.

In this embodiment, during the drying operation in which the fan 13 and the hater 14 are being driven, the controller 12 transmits control signals to the control circuit 17 inside the hair removing apparatus main body 3 via the cleaning device side transmission unit 15 and the hair removing apparatus side transmission unit 16, to thereby drive the driving body 2*a* of the hair clipping unit 2. That is, in case of an electric shaver, a movable blade forming a cutter block, which serves as the driving body 2*a*, is operated to reciprocate in sliding motions during the drying operation, or in case of an epilator, grasping members serving as the driving body 2*a* are operated to make rotary and opening/closing motions during the drying operation. As shown in FIG. 2, the above-described operation of the driving body 2*a* is initiated as soon as the drying operation is started and is continued throughout the drying operation, and when the drying operation is finished, the controller 12 transmits a control signal to stop the operation of the driving body 2*a*.

Under the above-described control by the controller 12, fluid drops attached to the hair clipping unit 2, particularly to the driving body 2*a*, are shaken and fallen off, so that the drying speed improves. In addition, even fluid drops still remaining on the driving body 2*a* that have not been shaken off are rapidly collected near the heater 14 beneath the hair clipping unit 2 by this operation and are dried off very quickly by heat or forced air due to their increase in surface area. That is, by the synergy effect of the operation of the driving body 2*a* of the hair clipping unit 2 and the drying operation by heating or air blow, the drying speed of the hair clipping unit 2 increases greatly. Moreover, since the fluid drops attached to the hair clipping unit 2 are shaken and fallen, sebum or other contaminants dissolved in the attached fluid drops are prevented from being left on the surface of the hair clipping unit 2 after it is dried.

Further, the configuration of the cleaning device side transmission unit 15 and the hair removing apparatus side transmission unit 16 for transmitting control signals is not limited to the above example where they are electrically connected by directly contacting each other by using connection terminals. For example, the cleaning device side transmission unit 15 and the hair removing apparatus side transmission unit 16 can be made of a primary coil and a secondary coil, respectively, and when the hair removing apparatus 1 is placed such that the two transmission units 15 and 16 are faced with each other, the two transmission units 15 and 16 can be magnetically connected, there by eliminating a need for contact.

Figure 3:
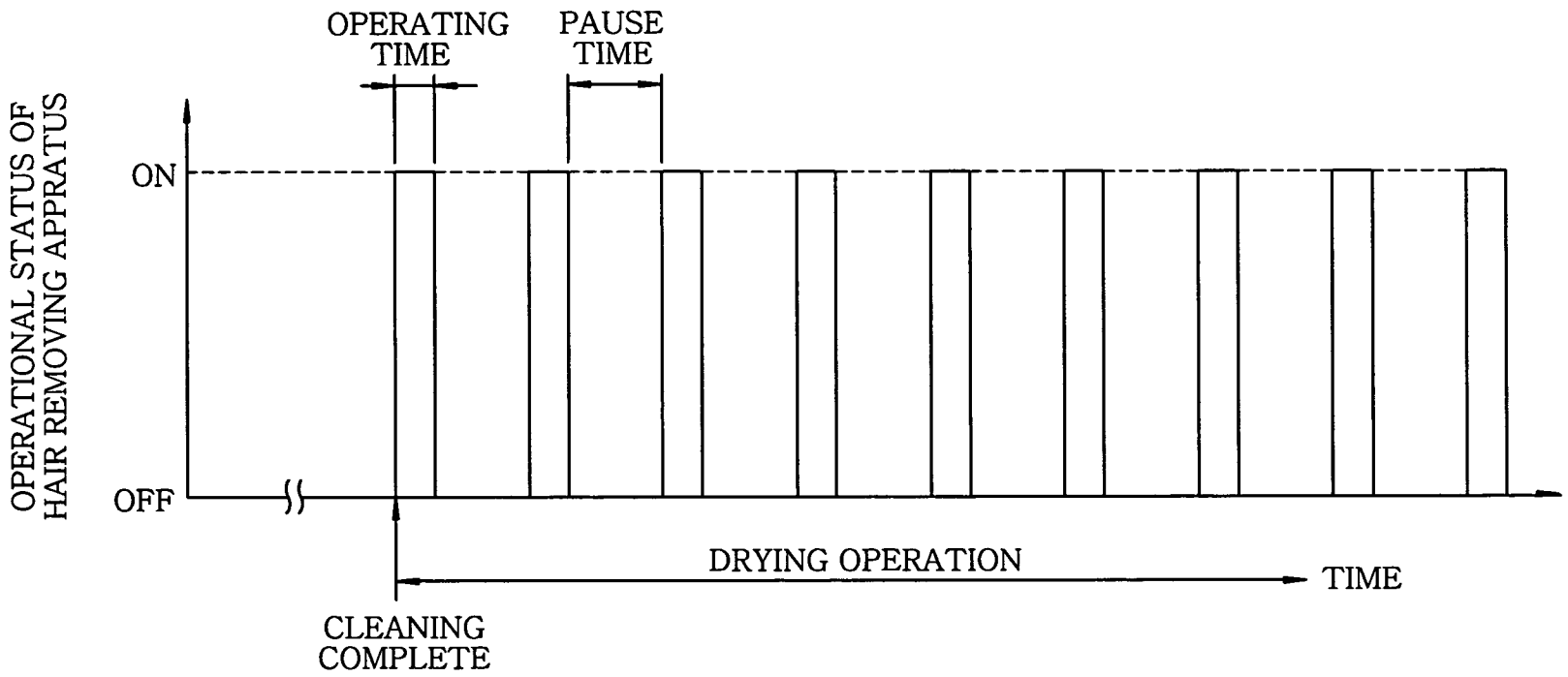
FIG. 3 illustrates a timing chart to schematically describe a second example of the operational status of the hair removing apparatus during a drying operation of the cleaning device of FIG. 1.

Moreover, the hair clipping unit 2 can be intermittently driven as shown in FIG. 3, unlike the example of FIG. 2 where it is driven continuously. Particularly, in a case where the hair removing apparatus 1 is an electric shaver whose driving body 2*a* is a cutter block consisting of a stationary blade and a movable blade, the edges of the blades would be abraded and their lifetime would be shortened, if the movable blade is continuously reciprocated in sliding motion. For this reason, during the drying operation, by driving the driving body 2*a* in an intermittent operation mode in which an operating time and a pause time of the driving body 2*a* are alternated, the reduction of the lifetime of the blade edges can be minimized.

Figure 4:
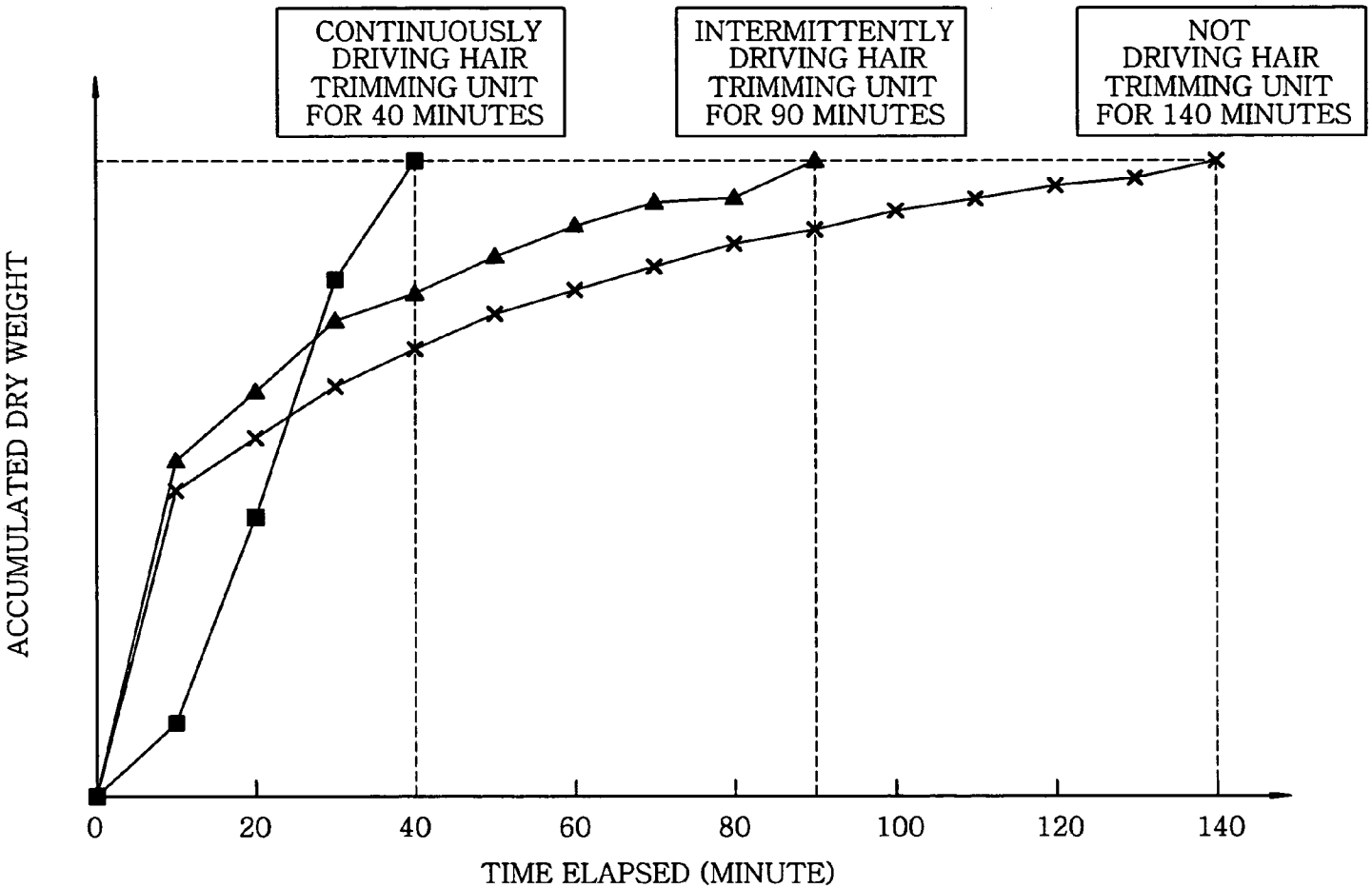
FIG. 4 illustrates a graph comparing drying time of the cleaning device of FIG. 1 for each operational condition.

FIG. 4 provides a diagram for the comparison of a case where a drying operation is performed without driving a hair clipping unit 2 of a hair removing apparatus 1; a case where a drying operation is performed while driving the hair clipping unit 2 continuously; and a case where a drying operation is performed while driving the hair clipping unit 2 intermittently. Here, an electric shaver whose movable blade is linearly driven at about 13000 strokes per a minute is used as the hair removing apparatus 1. The intermittent driving is performed under the condition that the hair clipping unit 2 is driven for two seconds every three minutes (i.e., an operating time of two seconds and a pause time of two minutes and fifty-eight seconds are alternated). As for the other conditions in the experiment, the temperature of the exterior air is 10 degrees centigrade and its humidity is 90%.

As shown in FIG. 4, if the hair clipping unit 2 is not driven, 140 minutes is required until a dried weight (or an amount of vaporized water) reaches a reference level. However, if the hair clipping unit 2 is driven continuously, the drying time is greatly reduced and only 40 minutes is required. Further, if the hair clipping unit 2 is driven intermittently, 90 minutes is required.

From the above result, it is confirmed that with the intermittent driving of the hair clipping unit 2, the drying time can be effectively reduced as much as about 50%, while keeping the noise generation at a minimum. In order to minimize the reduction of the blade lifetime or to suppress the noise generation, a ratio between the operating time and the pause time is preferably set to be less than 1 (i.e., the operating time is shorter than the pause time) and, more preferably, no greater than ½.

Figure 5:
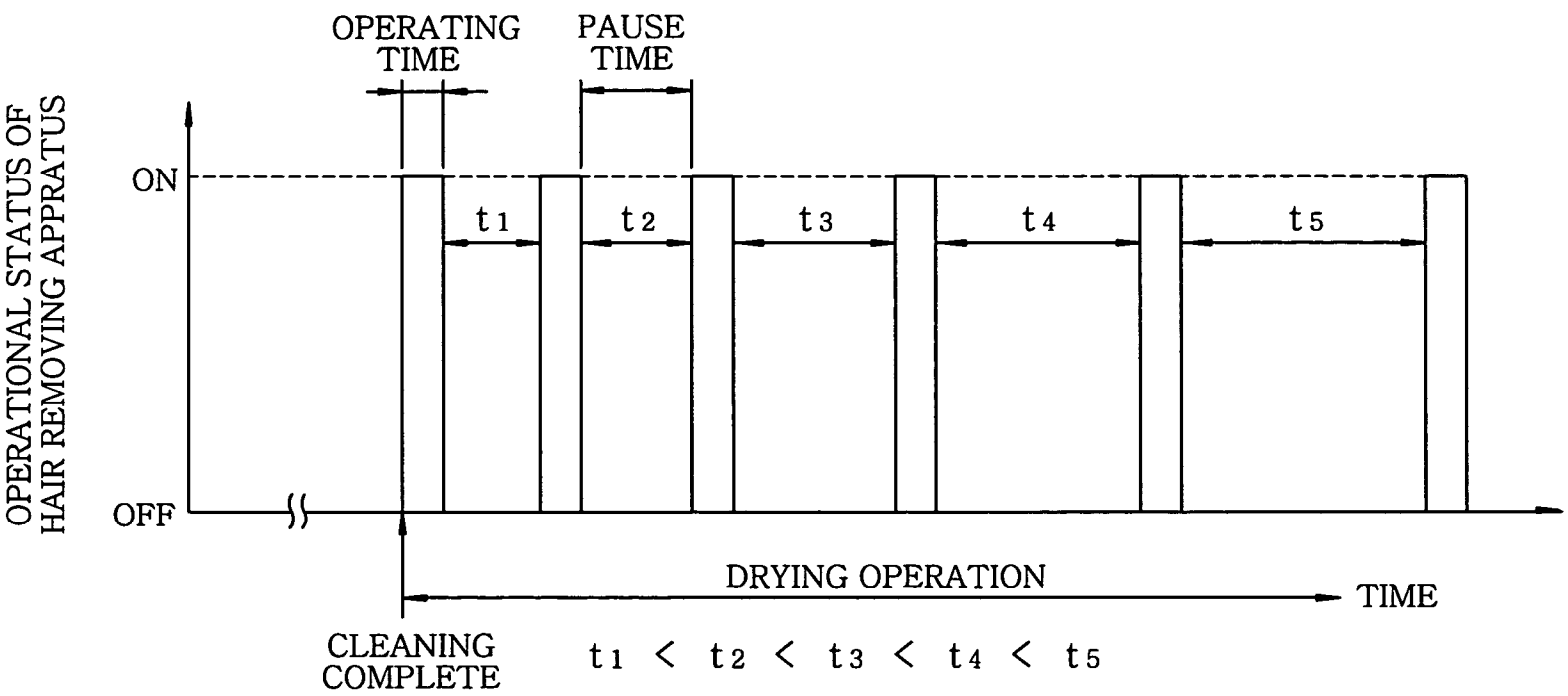
FIG. 5 illustrates a timing chart to schematically describe a third example of the operational status of the hair removing apparatus during a drying operation of the cleaning device of FIG. 1.

FIG. 5 presents another example of the operational status of the hair removing apparatus during a drying operation of the cleaning device in accordance with the first embodiment of the present invention.

In this example, the controller 12 embedded in the cleaning device intermittently drives the hair clipping unit 2 such that its operating time and pause time are alternated, while the fan 13 and the heater 14 of the drying mechanism B are being driven, and the pause time is controlled to increase with the lapse of time after the operation of the hair clipping unit 2 has started. In the example shown in FIG. 5, assuming that the nth pause time is $t_n$ (n=1, 2, 3, etc.), the controller 12 performs the intermittent driving control of the hair clipping unit 2 such that $t_{n+1}$ is larger than $t_n$ ($t_n<t_{n+1}$).

Since the amount of the cleaning fluid 30 remaining on the hair clipping unit 2 decreases with the lapse of time, the time period before a sufficient amount of fluid drops are collected at the lower part of the hair clipping unit 2 becomes longer. Thus, as in this example, by increasing the interval between an end of a current operating time and a start of a next operating time (i.e., a pause time therebetween) with the lapse of time, the hair clipping unit 2 can be prevented from being driven unnecessarily longer, thereby reducing its lifetime and noise generation.

Now, a cleaning device of a hair removing apparatus in accordance with a second embodiment of the present invention will be explained in connection with FIGS. 6 and 7. The basic configuration of this embodiment is identical with that of the first embodiment, so detailed description of the same parts will be omitted, and only distinctive features will be elaborated.

Figure 6:
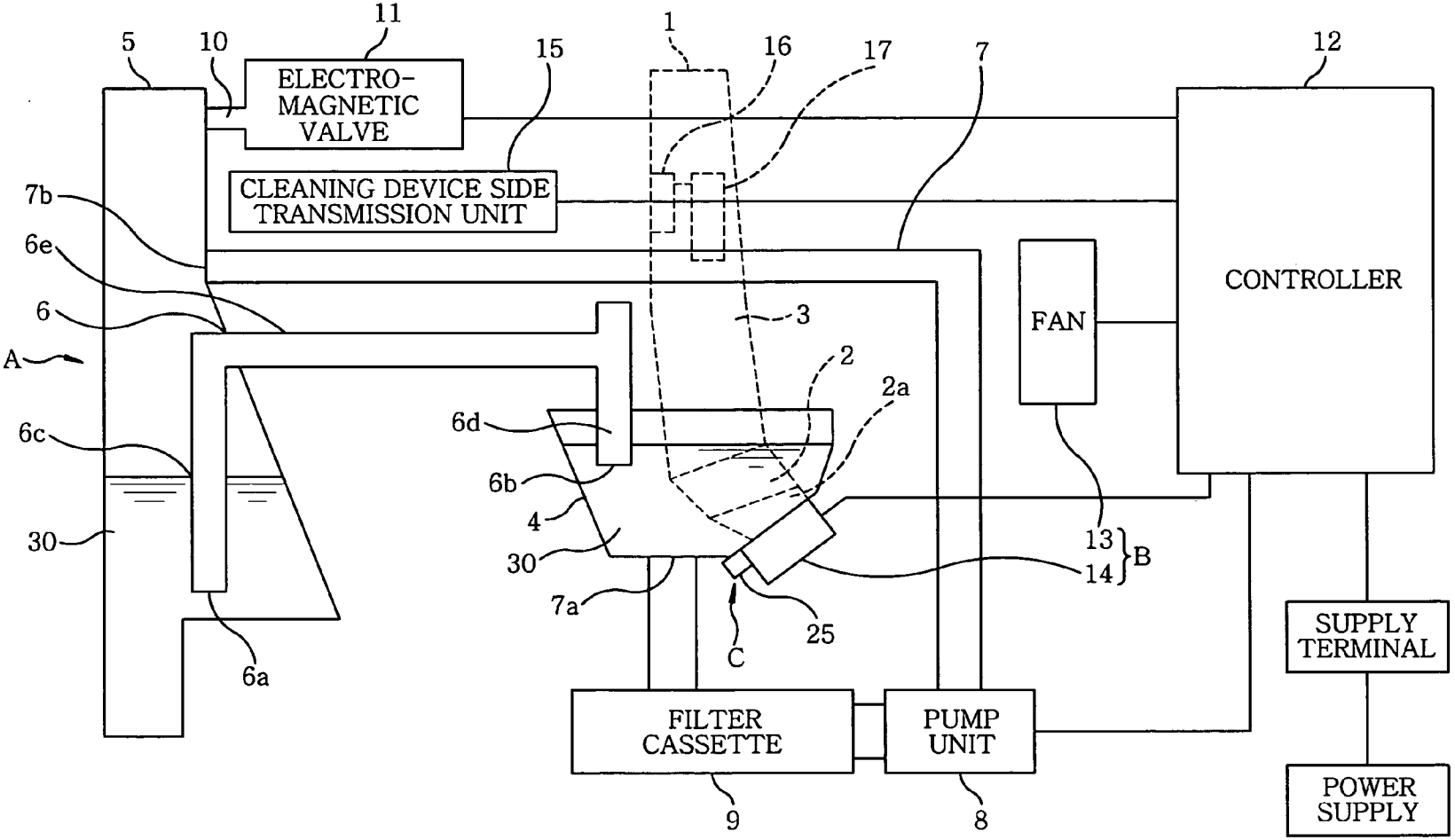
FIG. 6 illustrates a block diagram to schematically illustrate a cleaning device of a hair removing apparatus in accordance with a second embodiment of the present invention.

The cleaning device of this embodiment is illustrated in FIG. 6. Though its basic configuration is identical with that of the first embodiment, it additionally has a dryness detecting unit C for detecting dryness of a hair clipping unit 2, unlike the cleaning device described in the first embodiment. A controller 12 embedded in the cleaning device stops the operation of the hair clipping unit 2 when it determines that the hair clipping unit 2 is sufficiently dried based on a signal received from the dryness detecting unit C.

The dryness detecting unit C is made from a temperature sensor (thermistor) 25 installed at a rear bottom surface of a cleaning basin 4 near a driving body 2*a* of the hair clipping unit 2. The temperature sensor 25 serves to detect the temperature of the hair clipping unit 2, particularly its driving body 2*a*, indirectly based on the heat transferred from the cleaning basin 4 that is in contact with the driving body 2*a*. Provided in the lower part of FIG. 7 is a variation of a temperature which is converted from a voltage reading of the temperature sensor 25 which is varied by the heat transfer.

Figure 7:
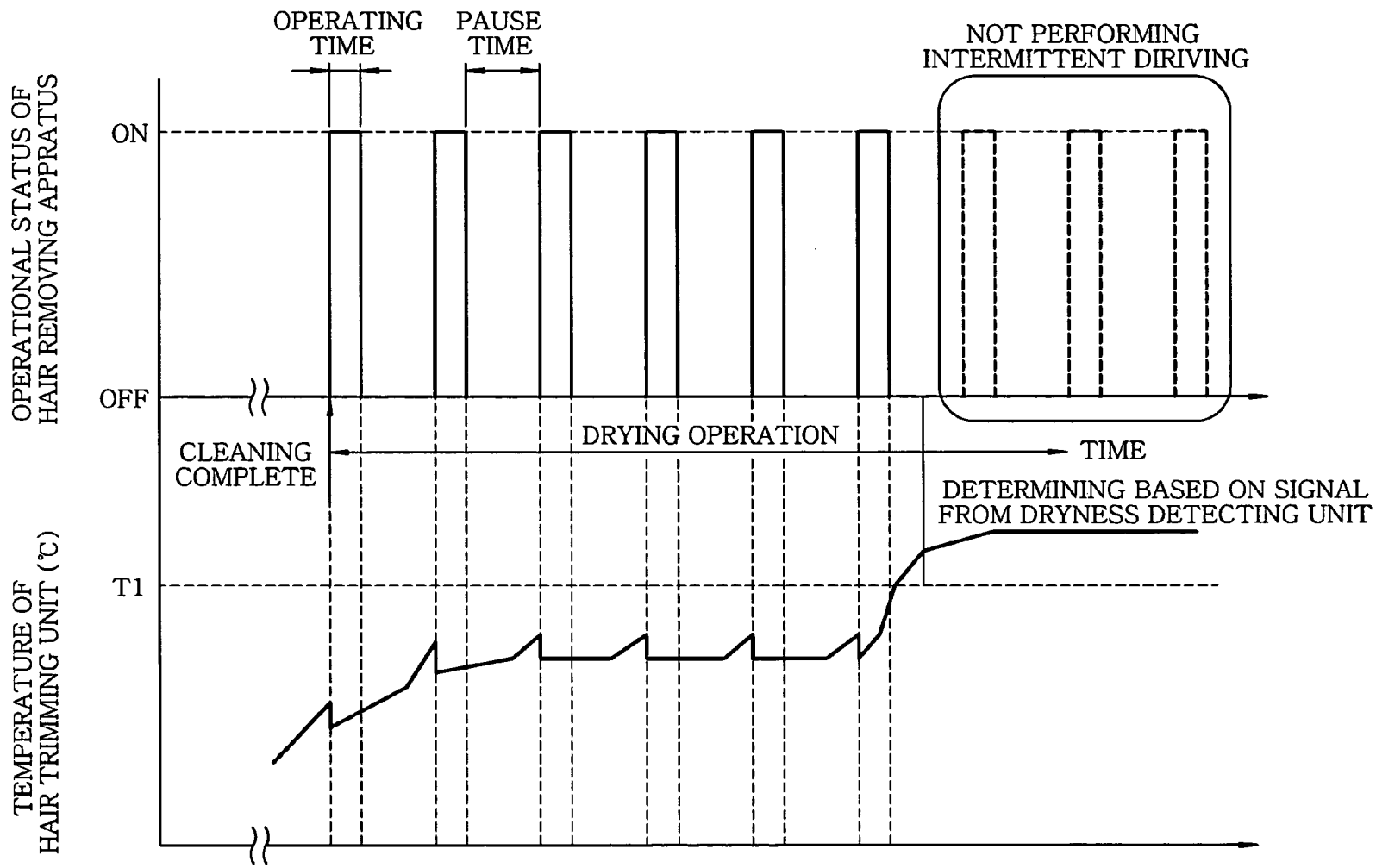
FIG. 7 illustrates a timing chart to schematically describe an operational status of the hair removing apparatus and a temperature of a hair clipping unit during a drying operation of the cleaning device of FIG. 6.

As shown in FIG. 7, if a heater 14 is operated after a drying operation is started, a detection temperature inputted to the controller 12 from the temperature sensor 25 begins to increase, however while the driving body 2*a* is driven, the detection temperature decreases temporarily. This reduction is caused because fluid drops are fallen or their surface areas are enlarged by the operation of the driving body 2*a*, accelerating the drying process.

If the operation of the driving body 2*a* stops, the detection temperature increases again. However, if it reaches a certain temperature value, a quantity of heat applied from the heater 14 is balanced with a quantity of evaporation heat of the fluid drops, thereby maintaining the detection temperature approximately constant. However, as the time passes, the detection temperature starts to increase rapidly because not enough fluid drops are present on the driving body 2*a* to balance out the heat being generated by the heater. The temperature then continues to increase until the detection temperature reaches a constant through a balance between a quantity of heat emitted from the driving body 2*a* to the ambient air and a quantity of heat applied from the heater 14.

A threshold value T1, for use in detecting the rapid temperature rise occurring when the driving body 2*a* is sufficiently dried, is set in the controller 12. That is to say, if the detection temperature from the temperature sensor 25 exceeds the threshold value T1, the controller 12 determines that the driving body 2*a* is completely dried, and outputs a control signal to stop the operation of the hair clipping unit 2 completely. However, even after the hair clipping unit 2 stops, the fan 13 and the heater 14 forming the drying mechanism B will still be operational for a certain period of time to dry hair clipping unit 2's other parts than the driving body 2*a* or the cleaning basin 4 sufficiently, and after the lapse of the certain time period, they will stop.

By using the above-described control mechanism, a negative influence on the lifetime of the hair clipping unit 2 and from the noise generated from the hair clipping unit 2 when it is driven can be minimized. Moreover, by using the temperature sensor 25 as the dryness detecting unit C, the dryness of the apparatus can be accurately detected based on a temperature variation, whereby it becomes possible to stop the hair removing apparatus 1 at a proper time without making a wrong detection.

While the invention has been shown and described with respect to the embodiments, it will be understood by those skilled in the art that various changes and modifications may be made without departing from the scope of the invention as defined in the following claims.

What is claimed is:

1. A cleaning device for a hair removing apparatus having a hair clipping unit for removing hair, comprising:

a cleaning basin for accommodating the hair clipping unit therein;

a fluid circulating mechanism for supplying or recovering cleaning fluid into or from the cleaning basin;

a drying mechanism for drying the hair clipping unit in the cleaning basin after the hair clipping unit is cleaned; and a controller for controlling the fluid circulating mechanism and the drying mechanism, wherein the controller is configured to transmit a control signal to the hair removing apparatus to drive the hair clipping unit while the drying mechanism is being operated, and wherein the controller is configured to drive the hair clipping unit intermittently while the drying mechanism is being operated.

2. The cleaning device of claim 1, wherein during the intermittent driving of the hair clipping unit, an operating time of the hair clipping unit is set by the controller to be shorter than a pause time thereof.

3. The cleaning device of claim 1, further comprising a dryness detecting unit for detecting dryness of the hair clipping unit of the hair removing apparatus, wherein the controller stops the operation of the hair clipping unit when it determines that the hair clipping unit is completely dried based on a detection signal provided by the dryness detecting unit.

4. The cleaning device of claim 3, wherein the dryness detecting unit is made from a temperature sensor for detecting the temperature of the hair clipping unit.

5. A cleaning device for a hair removing apparatus having a hair clipping unit for removing hair, comprising:

a cleaning basin for accommodating the hair clipping unit therein;

a fluid circulating mechanism for supplying or recovering cleaning fluid into or from the cleaning basin;

a drying mechanism for drying the hair clipping unit in the cleaning basin after the hair clipping unit is cleaned; and a controller for controlling the fluid circulating mechanism and the drying mechanism, wherein the controller is configured to transmit a control signal to the hair removing apparatus to drive the hair clipping unit while the drying mechanism is being operated, wherein the controller is configured to drive the hair clipping unit intermittently while the drying mechanism is being operated, and wherein during the intermittent driving of the hair clipping unit, a pause time is set by the controller to increase with a lapse of time after the intermittent driving of the hair clipping unit has begun.

6. The cleaning device of claim 5, wherein during the intermittent driving of the hair clipping unit, an operating time of the hair clipping unit is set by the controller to be shorter than the pause time thereof.

7. The cleaning device of claim 5, further comprising a dryness detecting unit for detecting dryness of the hair clipping unit of the hair removing apparatus, wherein the controller stops the operation of the hair clipping unit when it determines that the hair clipping unit is completely dried based on a detection signal provided by the dryness detecting unit.

8. The cleaning device of claim 7, wherein the dryness detecting unit is made from a temperature sensor for detecting the temperature of the hair clipping unit.

* * * * *